United States Patent [19]

Buckley

[11] 4,208,983

[45] Jun. 24, 1980

[54] CONTAINER FOR SYMBOLICALLY INDICATING PHARMACEUTICAL PRESCRIPTION

[76] Inventor: Walter S. Buckley, 1202 B Westlake Blvd., Westlake Village, Calif. 91361

[21] Appl. No.: 934,485

[22] Filed: Aug. 17, 1978

[51] Int. Cl.[2] ..... G09F 9/00

[52] U.S. Cl. ..... 116/205; 40/312; 116/308; 206/539

[58] Field of Search ..... 116/121, 133, 136.5, 116/DIG. 15, DIG. 17, 205, 308; 40/311, 312; 35/39 A, 35 H; 206/539; 215/200, 203, 230, DIG. 3

[56] References Cited

U.S. PATENT DOCUMENTS

| | | | |
|---|---|---|---|
| 2,066,183 | 12/1936 | Mehaffey | 215/230 X |
| 2,456,155 | 12/1948 | Seaman | 35/35 A |
| 2,587,147 | 2/1952 | Guion et al. | 40/311 |
| 2,713,845 | 7/1955 | Silverman | 116/308 |
| 2,817,451 | 12/1957 | Giles et al. | 116/133 X |
| 3,446,179 | 5/1969 | Bender | 116/121 |
| 3,537,422 | 11/1970 | Moe | 206/539 X |
| 3,648,647 | 3/1972 | Joy | 116/205 |
| 4,119,809 | 10/1978 | Biachini | 35/35 A X |

*Primary Examiner*—Donald Watkins

[57] ABSTRACT

The present invention relates to a pharmaceutical container capable of symbolically indicating a prescription dose and time requirements. The container and symbolic message adapted to be physically sensed by touch, are particularly suited for circumstances where a patient may not read English, have poor vision, or be blind.

5 Claims, 4 Drawing Figures

CONTAINER FOR SYMBOLICALLY INDICATING PHARMACEUTICAL PRESCRIPTION

BACKGROUND OF THE INVENTION

1. Field of the Invention

The present invention relates generally to methods for symbolically representing prescriptions on containers for the blind, illiterate or those having poor vision.

2. Prior Art

The common practice of physicians administering drugs, pills or other tablets is to prescribe such medication from a pharmacy. The pharmacy then packages the medication within a container and labels the container indicating the dosage and particular times at which the dosage is to be taken. The most common type of labeling is for the pharmacist to type specific instructions on a gummed label which is applied to the container. Such labels are inherently defective for even a normal person, in that smearing of the lettering or tearing of the label may cause the patient to be mistaken regarding the particular dosage and time of administration. This is critical since all drugs are potentially dangerous when improperly administered.

This problem is more difficult for certain handicapped persons since they have to not only memorize the prescription, but associate it with the proper container.

The unsupervised administration of prescriptions is extremely difficult for blind people or people having poor sight or being illiterate or speaking a foreign language. Under these conditions, the patient may misread or be unable to read at all, the particular prescription. The druggist may inform the particular patient of the dosage and time and time increment for administration, but then it is up to the patient to remember the prescription and associate it with the particular container. Many blind people use techniques such as placing rubber bands around bottles, or placing them in different locations. If a patient has more than one medication to take, and such is often the case, the person with the particular handicap such as being blind, has a tremendous problem confronting himself first to memorize the prescription and then to associate it with the proper container.

There are no prior art implements known to applicant, which specifically address the problem of symbolically attempting to inform a patient of the dosage and of the frequency of a medication. There are several devices which have been previously patented which by various means, attempt to aid a person in remembering when the last dosage was taken. One such example in U.S. Pat. No. 2,706,464, issued to Harold D. North. That Patent describes a specific container having a top and bottom portion which are capable of being fitted together so as to remain in a fixed position. This is accomplished by fluting the cap and container, such that when the cap is pushed into the body, it will remain in that fixed position. The cap or body is marked with indicia describing a particular dosage period, such as a 24 hour period. The body has inscribed thereon, an arrow with the inscription "last taken". The user can then dispose the arrow so as to align with indicia representing the time the last dosage was taken. Thus, a patient may utilize a container to remind him of when the last dosage was taken. This invention, however, does not accomplish or aid the blind person or illiterate person in determining; First, the particular medication; Second, the dosage; or Third, the time to administer the dosage. That patent does describe impressing the cap and body with relief numbers and indicia at least, to the extent of inscribing the cyclic period and arrow indicating the last time a dosage was taken. The problem is that it does not, and cannot, represent the dosage requirements. In the case of a handicapped person, blind, it is very difficult to reset the indicator after each use. Furthermore, the Patent does not teach use of symbolically representing dosage and frequency requirements.

Another series of Patents have been obtained on particular containers which have structure capable of being maintained in several positions for use with prescriptions where a predetermined number of pills is taken in each cycle. In operation, the container has several interior compartments into which a pill or pills is placed, an opening in the container may be displaced selectively from one compartment to the other for mechanically insuring proper administration. A typical example is that container used for the pill for preventing pregnancy. That container is set up on a specific twenty-one daytime cycle and can be rotated from one position to the next. Each day, a user rotates the container to take the prescription for that day. Another example of such a container is that described in U.S. Pat. No. 3,446,179, issued to Samuel Bender. That container like the North patent, has indicia for indicating when the next dosage is to be administered. The Patent further requires two separate compartments within the container, one of which will contain the next dosage to be taken. Thus, a user, after taking the dosage, can put the new dosage from the main compartment into the secondary compartment, thereby readying the container for the next dosage. The medication is placed into the secondary compartment based on the known dosage just administered.

No prior art device exists which symbolically attempts to indicate to a patient the dosage, and the time cycle for which the dosage should be taken. There are no prescription containers presently available to a blind person, to an illiterate person or to a person who does not speak English, which is usable. To date, symbolic representations have been by gummed labels which are typed onto the bottle or container.

The present invention provides a structure which can be formed as part of any standard presciption container or can be attached to any standard container, that symbolically represents to a user, the particular dosage and times for each dosage to be taken. The particular invented structure protects the blind, illiterate, or non-English speaking person from the numerous problems inherent in typewritten, gum labeled messages.

SUMMARY OF THE INVENTION

A device for providing a symbolic representation of a pharmaceutical prescription on the container is disclosed. The device is comprised of at least two portions; one of which has a relief symbol representing a tablet and a plurality of protrusions extending therefrom, which may be selectively removed to leave the specific number of protrusions representing the specified dosage, ie., three protrusions means three tablets; the second portion having a relief symbol representing time and a plurality of protrusions extending therefrom, which may be selectively removed to leave the specific number of protrusions to represent the time cycle of the dosage.

It is an object of the invention to provide a symbolic representation of a pharmaceutical prescription on a medication container for the blind, poor of vision, illiterate, and non-English speaking patients, capable of being sensed by touch.

It is an object of the invention to provide an inexpensive, safe device for mass manufacture, medication containers having symbolic representations of the prescription.

It is still another object of the invention to provide a method for symbolically representing the prescription which can be easily attached to presently existing medication containers.

DETAILED DESCRIPTION OF THE PREFERRED EMBODIMENT

Figure 3:
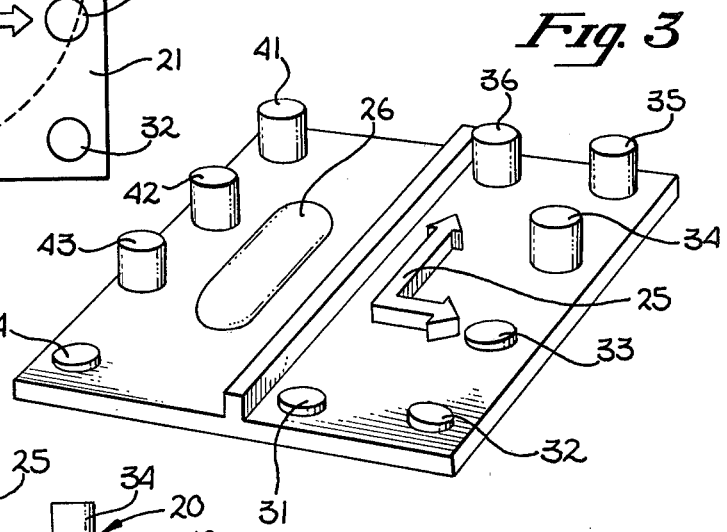
FIG. 3, is a prespective view of the preferred form of the present invention.

The present invention is a device for symbolically representing a pharmaceutical prescription on a medication container. The particular device is comprised of at least two sections, one of which indicates the particular dosage requirements of the prescription and the second of which indicates the time element for administration of the dosage. The particular invention can be adapted to be used on any standard pharmaceutical container. Such a container 10, is indicated generally, in FIG. 2, having an enclosed bottom end 11, and an open end 12. A closure member labeled generally 30, is shown disposed in open end 12, of FIG. 2. The preferred form of the invention is best illustrated in FIG. 3. However, it should be pointed out that the particular form illustrated in FIG. 3, is only the preferred form which can be modified or adapted to many shapes and sizes, or modified and still symbolically represent any pharmaceutical prescription.

Figure 1:
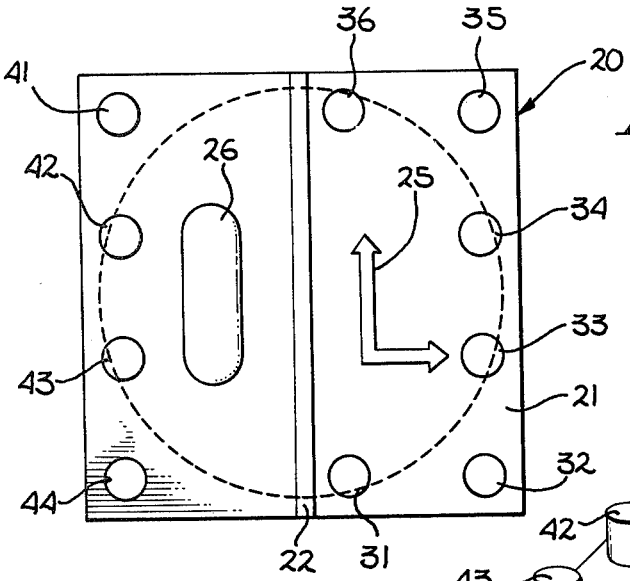
FIG. 1, illustrates a top view of an alternate form of the invention formed as an integral part of the lid for the medication container.

Referring first to FIG. 1, the preferred form of the present invention will be described in detail. The preferred form is comprised of a single base member 20, having an upper surface 21, which is divided by a raised continuous member 22, into two portions 23 and 24. Portion 23 is used to symbolically represent the dosage, ie., the number of pills to be taken at each timed interval. Side 24 is used to symbolically represent the particular time periods for taking each dosage.

Referring still to FIG. 3, specifically to portion 23, a relief capsule 26, is shown disposed thereon. Relief capsule 26, may be formed intricately with base 20 or coupled thereto. The raised capsule can be felt by the finger of the patient and will indicate that this portion 23 contains the symbolic message representing the particular dosage, ie., number of tablets or capsules to be taken at each timed interval.

Also disposed on portion 23, are a plurality of protrusions. The protrusions in the preferred form are indicated by four small cylindrical elements 41, 42, 43, and 44. These protrusions in this form, are formed as a portion of the base 20 and are adapted to be capable of being selectively sheared close to the top surface 21 of base 20. In the preferred form, only four protrusions are utilized, it being acknowledged that any other reasonable number of the protrusions could also be used. It has been found however, that the most convenient number required would be four. In the preferred form, the protrusions are formed as part of the base 20 and are formed of a semi-rigid plastic material. In use, a pharmacist, knowing the prescription, can selectively shear by use of scissors, or other cutting instrument, the appropriate number of protrusions, leaving the same number remaining as tablets to be taken. In the form shown in FIG. 3, protrusion 44, has been severed off, leaving three protrusions, indicating to the patient that three tablets are to be taken at each time interval. It should be noted that protrusion 44 is shown as not being trimmed at surface level 21. The practice shear plane is not critical since most persons utilizing the device will be able to feel distinctly the precise number of protrusions remaining. It is, however, better practice to shear the protrusions off near the surface level 21.

Portion 24 has thereon, a raised pair of arrows 25 intersecting at 90° representing hour hands of a clock. In the preferred embodiment, it is proposed that the raised arrows 25 symbolically indicate the time of day, however, in an alternate embodiment, different symbolic devices may be used to represent time. In the preferred form, the raised arrows are formed as a part of base member 20, but may be coupled thereto in an alternate embodiment. Disposed on surface 21 of the preferred embodiment are a plurality of protrusions numbered 31, 32, 33, 34, 35, and 36. In an alternate embodiment, more than six protrusions could be employed to indicate the time element at which the dosage is to be taken. In the preferred embodiment, the protrusions indicate the number of times a particular dosage is to be taken in any 24 hour period. Thus, as illustrated in FIG. 3, protrusions 31, 32, and 33, have been removed by being sheared near surface 21. Thus, a person utilizing the symbolic message could feel with his fingers protrusions 34, 35, and 36 and know that the dosage is to be taken three times a day. The complete message indicated in FIG. 3, would be to take three tablets three times a day. In an alternate embodiment, protrusions indicating each hour of a day could be employed. The pharmacist could simply cut off the necessary protrusions to indicate the time at which each dosage should be taken. By using this simple method and structure, most any prescription can be represented in many forms, a few of which have been described.

It is important that divider 22, be sufficiently raised from surface 21, to provide readily ascertainable separation between portion 23 and portion 24. This permits a user to simply and readily discover the two particular message areas and decipher the symbolic code contained within each message area. In an alternate embodiment, it may be beneficial to provide three or more different symbolic code fields which could be accomplished in a manner similar to that previously described. In the preferred embodiment, it has been discovered that these two simple message areas provide sufficient information to adequately describe most prescriptions.

Figure 2:
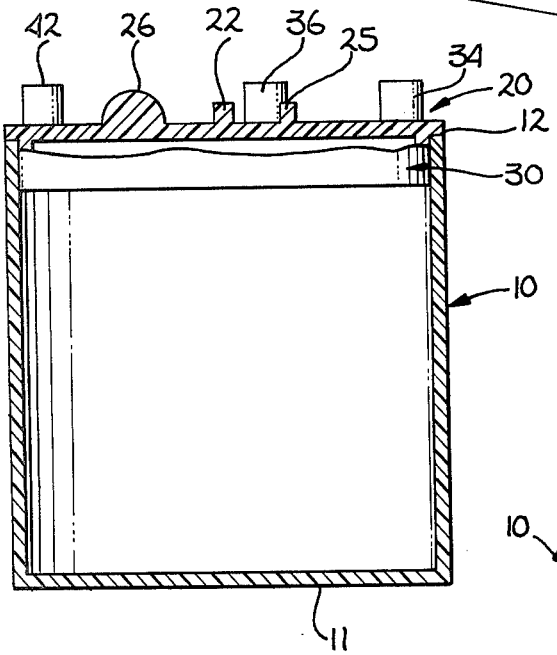
FIG. 2, is a cross-sectional view of Section 2—2 of FIG. 1.

In an alternate form of the invention, base 20 is formed as an integral part of the lid 30, as shown in FIG. 1 and FIG. 2. In this fashion, it is economical to form the entire lid and message structure in one simple operation. The lid is identical to those used on all of the standard containers and can be used interchangeably with the standard container. This permits a pharmacist to stock all standard containers and simply order a sufficient number of lids having the present invention formed thereon for his needs.

Figure 4:
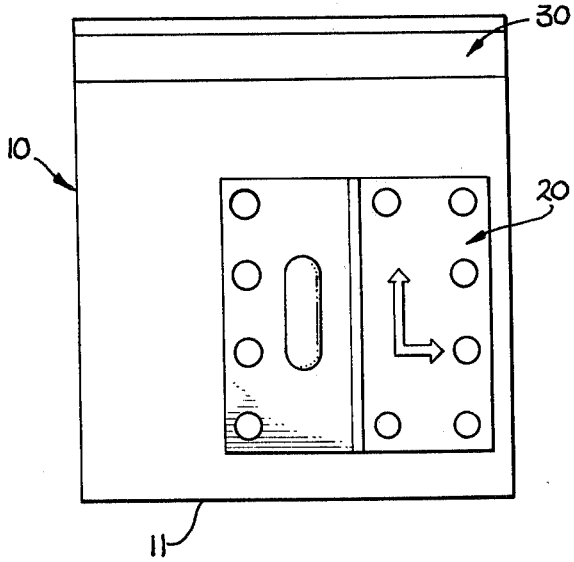
FIG. 4, is an elevation view of a standard medication container having the alternate embodiment of FIG. 3 disposed thereon.

An alternate embodiment of the invention is shown in FIG. 4. In that embodiment, the entire symbolic message contained on base 20, can be coupled to the side of a typical container by adhesive or other mechanical fastening means. In this particular form, the base 20 is made of soft plastic which is relatively flexible. A self adhesive glue could be disposed on the back side of base 20, thus making the entire base 20 capable of being coupled to a standard container upon desire.

In the preferred form, this structure may be made by modern methods of plastic molding, as, for example, thermal plastic injection, by which both the base and the projections may be formed of a firm, semi-rigid material such as ploystyrene or a polyvinyl material or the like.

However, while the preferred embodiment of the present invention has been described in detail herein, it will be understood by those skilled in the art that various changes in form and detail may be made therein without departing from the spirit and scope of the invention.

I claim:

1. A pharmaceutical container having a means for symbolically representing a prescription, for use by the blind, poor of vision, illiterate and the like, said means being divided into at least, a first and second portion, said first portion for indicating dosage requirements of a prescription, said second portion for indicating the time parameters of a prescription, said first portion having a first relief means disposed thereon, symbolically representing medication, and a plurality of protrusions, said protrusions capable of being individually and selectively sheared off to leave remaining the same number of protrusions as the dosage requirements of a prescription, said first relief means and protrusions for providing a symbolic message of the dosage requirements of a prescription.

2. The pharmaceutical container, having a means for symbolically representing a prescription for use by the blind, poor of vision, illiterate, and the like, said means divided into, at least, a first and second portion, said second portion for the time parameters of a prescription, said second portion comprising a second relief means and disposed thereon, symbolically representing time, and a plurality of protrusions, said protrusions capable of being individually and selectively sheared off to leave remaining the same number of protrusions as the time frequency requirements of a prescription, said second relief means and protrusions for providing a symbolic message of the time frequency requirements of a prescription.

3. A pharmaceutical container having a means for symbolically representing a prescription, for use by the blind, poor of vision, illiterate and the like, said means being divided into at least, a first and second portion, said first portion for indicating dosage requirements of a prescription, said second portion for indicating the time parameters of a prescription, said first portion having a first relief means disposed thereon, symbolically representing medication, and a plurality of protrusions, said protrusions capable of being individually and selectively sheared off to leave remaining the same number of protrusions as the dosage requirements of a prescription, said second portion comprising a second relief means disposed thereon, symbolically representing time, and a plurality of protrusions, said protrusions capable of being individually and selectively sheared off to leave remaining the same number of protrusions as the time frequency requirements of a prescription, said first relief means and protrusions for providing a symbolic message of the dosage requirements of a prescription, second relief means and protrusions for providing a symbolic message of the time frequency requirements of a prescription.

4. The pharmaceutical container of claim 3, wherein said first relief means is a capable, tablet, a pill, or the like.

5. The pharmaceutical container of claim 3, wherein said second relief means is a pair of arrows intersecting at 90°.

* * * * *